US008931310B2

(12) United States Patent
Risen et al.

(10) Patent No.: US 8,931,310 B2
(45) Date of Patent: Jan. 13, 2015

(54) BULK DISPENSING SYSTEM FOR WASHING MACHINE

(75) Inventors: Carl W. Risen, Louisville, KY (US); Jerrod A. Kappler, Louisville, KY (US); Joseph Duane Tobbe, Taylorsville, KY (US)

(73) Assignee: General Electric Company, Schenectady, NY (US)

( * ) Notice: Subject to any disclaimer, the term of this patent is extended or adjusted under 35 U.S.C. 154(b) by 1110 days.

(21) Appl. No.: 11/432,564

(22) Filed: May 11, 2006

(65) Prior Publication Data

US 2007/0261177 A1 Nov. 15, 2007

(51) Int. Cl.
*D06F 39/02* (2006.01)

(52) U.S. Cl.
CPC ..... *D06F 39/02* (2013.01); *D06F 2202/02* (2013.01); *D06F 2202/04* (2013.01); *D06F 2202/085* (2013.01); *D06F 2202/10* (2013.01)
USPC ..... 68/17 R; 68/12.18

(58) Field of Classification Search
CPC ..... D06F 39/02
USPC ..... 68/17 R
See application file for complete search history.

(56) References Cited

U.S. PATENT DOCUMENTS

| | | | | |
|---|---|---|---|---|
| 3,826,113 | A | 7/1974 | Boraas et al. | |
| 4,835,991 | A * | 6/1989 | Knoop et al. | 68/12.19 |
| 4,845,965 | A | 7/1989 | Copeland et al. | |
| 4,932,227 | A | 6/1990 | Hogrefe | |
| 5,390,385 | A | 2/1995 | Beldham | |
| 5,392,618 | A | 2/1995 | Livingston et al. | |
| 5,435,157 | A | 7/1995 | Laughlin | |
| 5,743,442 | A | 4/1998 | Barbe | |
| 5,758,521 | A | 6/1998 | Roberts | |
| 6,065,170 | A * | 5/2000 | Jang | 8/158 |
| 6,065,171 | A * | 5/2000 | Tubman et al. | 8/158 |
| 6,401,499 | B1 * | 6/2002 | Clark et al. | 68/17 R |
| 6,463,611 | B1 | 10/2002 | Mattia et al. | |
| 7,036,175 | B2 | 5/2006 | Sears | |
| 7,681,328 | B2 * | 3/2010 | DuVal et al. | 34/597 |
| 2006/0117811 | A1 * | 6/2006 | Kinnetz | 68/17 R |

FOREIGN PATENT DOCUMENTS

| | | | | |
|---|---|---|---|---|
| EP | 0379950 | A1 | 8/1990 | |
| EP | 0597513 | A1 * | 10/1993 | D06F 39/10 |
| EP | 611159 | A1 * | 8/1994 | A47L 15/44 |

(Continued)

OTHER PUBLICATIONS

Office Action from corresponding Canadian Application No. 2561674, dated Mar. 1, 2013.

*Primary Examiner* — Michael Barr
*Assistant Examiner* — Jason Riggleman
(74) *Attorney, Agent, or Firm* — Global Patent Operation; Douglas D. Zhang

(57) ABSTRACT

A bulk dispensing system for a washing machine is provided. The bulk dispensing system includes at least one bulk storage tank mounted within the washing machine. A tube provides fluid communication between the at least one bulk storage tank and a tub mounted within a cabinet of the washing machine. A pump is operatively coupled to the tube and configured to move fluid from within the at least one bulk storage tank into the tub through the tube. A controller is operatively coupled to the pump and configured to control an amount of fluid moved into the tub.

16 Claims, 5 Drawing Sheets

(56) References Cited

FOREIGN PATENT DOCUMENTS

| | | | | |
|---|---|---|---|---|
| FR | 2785302 A1 * | 5/2000 | ..... | D06F 39/02 |
| GB | 2214524 | 6/1989 | | |
| GB | 2214524 A * | 9/1989 | ..... | D06F 39/02 |
| JP | 2001157795 | 12/2000 | | |

* cited by examiner

BULK DISPENSING SYSTEM FOR WASHING MACHINE

BACKGROUND OF THE INVENTION

This invention relates generally to washing machines and, more particularly, to a bulk dispensing system for a washing machine.

Washing machines typically include a cabinet which receives a stationary tub for containing wash and rinse water. A wash basket is rotatably mounted within the tub, and an agitating element is rotatably positioned within the wash basket. A drive assembly and a brake assembly are positioned with respect to the wash tub and configured to rotate and control the agitation of the wash basket to cleanse the articles loaded into the wash basket. Upon completion of a wash cycle, a pump assembly is configured to drain the soiled water to a draining system.

At least one conventional washing machine includes a detergent dispenser assembly fixed to an inner portion of the cabinet. The detergent dispenser assembly includes a reservoir for containing the detergent and a cover that covers the reservoir to prevent the detergent from contacting moisture until a designated time during a wash cycle. During the wash cycle, the cover is opened and the detergent is released from the reservoir. However, a user may not be aware when the detergent runs out if the user forgets to check the reservoir before the wash cycle begins. This undesirably wastes energy resources, and may also cause machine problems and/or inconvenience for the user. Additionally, frequently adding detergent into the reservoir is also troublesome and/or time consuming. Further, accurately dispensing an appropriate amount of the detergent into the washing machine at an appropriate time during the wash cycle may be challenging.

BRIEF DESCRIPTION OF THE INVENTION

In one aspect, a bulk dispensing system for a washing machine is provided. The bulk dispensing system includes at least one bulk storage tank mounted within the washing machine. A tube provides fluid communication between the at least one bulk storage tank and a tub mounted within a cabinet of the washing machine. A pump is operatively coupled to the tube and configured to move fluid from within the at least one bulk storage tank to the tub through the tube. A controller is operatively coupled to the pump and configured to control an amount of fluid moved into the tub.

In another aspect, a washing machine is provided. The washing machine includes a cabinet. A tub is mounted within the cabinet. A first bulk fluid tank is positioned within the cabinet. A tube provides fluid communication between the first bulk storage tank and the tub. A peristaltic pump is operatively coupled to the tube and configured to move fluid from within the first bulk storage tank into the tub through the tube. A controller is in control communication with the peristaltic pump and configured to control an amount of fluid introduced into the tub.

In another aspect, a method is provided for dispensing a fluid into a washing machine including a cabinet and a tub positioned within the cabinet. The method includes providing the washing machine with a dispensing system. The dispensing system includes a bulk fluid storage tank. A tube provides fluid communication between the bulk fluid storage tank and the tub. A pump is operatively coupled to the tube and configured to move fluid from the bulk fluid storage tank to the tub. The dispensing system also includes a controller in control communication with the pump. An amount of water is introduced into the tub during a water fill cycle. An amount of fluid to dispense into the tub is determined based on at least one of a water temperature, a water hardness, a load size and a soil level within the tub. At least a portion of the determined amount of fluid is pumped through the tube and into the tub during the water fill cycle.

DETAILED DESCRIPTION OF THE INVENTION

Figure 1:
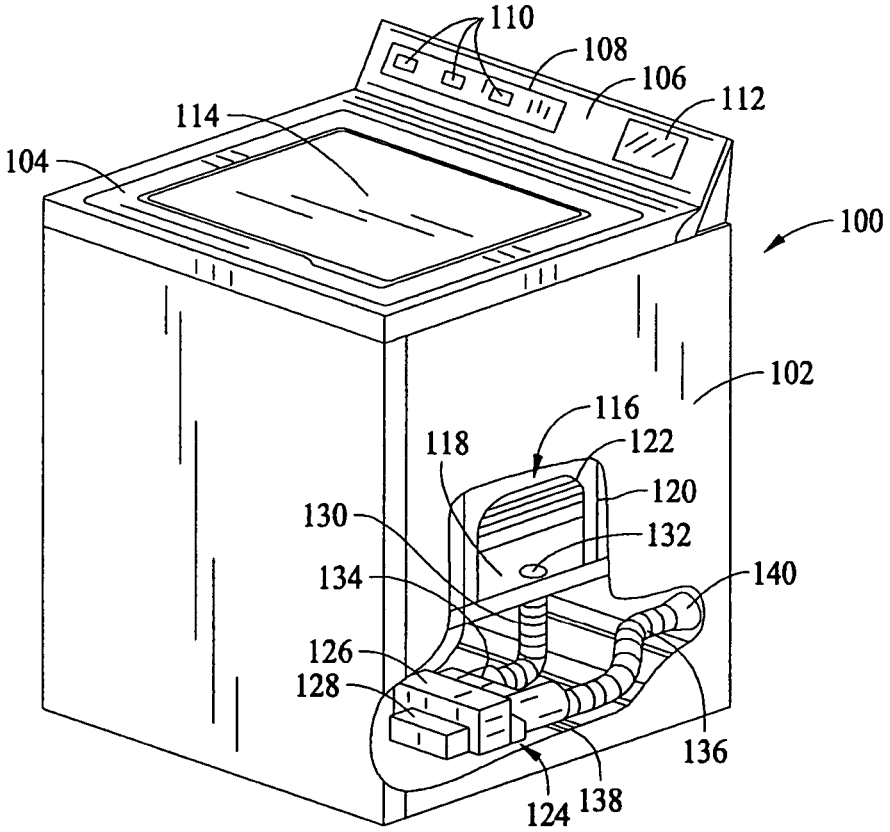
FIG. 1 is a perspective view of an exemplary washing machine with a portion of a cabinet removed.

FIG. 1 is a perspective view of an exemplary washing machine 100 with a portion of a cabinet of the washing machine removed. As shown in FIG. 1, washing machine 100 is a vertical axis washing machine. However, it is apparent to those skilled in the art and guided by the teachings herein provided that the present invention is suitable for use with other types of washing machines including, without limitation, horizontal axis washing machines.

Washing machine 100 includes a cabinet 102 and a cover 104. A backsplash 106 extends from cover 104. A control panel 108, including a plurality of input selectors 110, is coupled to backsplash 106. Control panel 108 and input selectors 110 collectively form a user interface input for operator selection of machine cycles and/or features. In one embodiment, a display 112 indicates selected features, a countdown timer, and/or other items of interest to the machine users. A lid 114 is hingedly mounted to cover 104 and is movable about a hinge (not shown) between an open position (not shown) for facilitating access to a wash tub 116 mounted within cabinet 102, and a closed position, as shown in FIG. 1, to sealingly cover wash tub 116.

Wash tub 116 includes a bottom wall 118 and a sidewall 120. A wash basket 122 is rotatably mounted within wash tub 116. In one embodiment, as shown in FIG. 1, a pump assembly 124 is located beneath tub 116 and wash basket 122 for gravity-assisted flow when draining wash tub 116. Pump assembly 124 includes a pump 126 and a motor 128. A pump inlet hose 130 extends from a wash tub outlet 132 in tub bottom wall 118 to a pump inlet 134, and a pump outlet hose 136 extends from a pump outlet 138 to a washing machine water outlet 140 and ultimately to a building plumbing system discharge line (not shown) in flow communication with water outlet 140.

Figure 2:
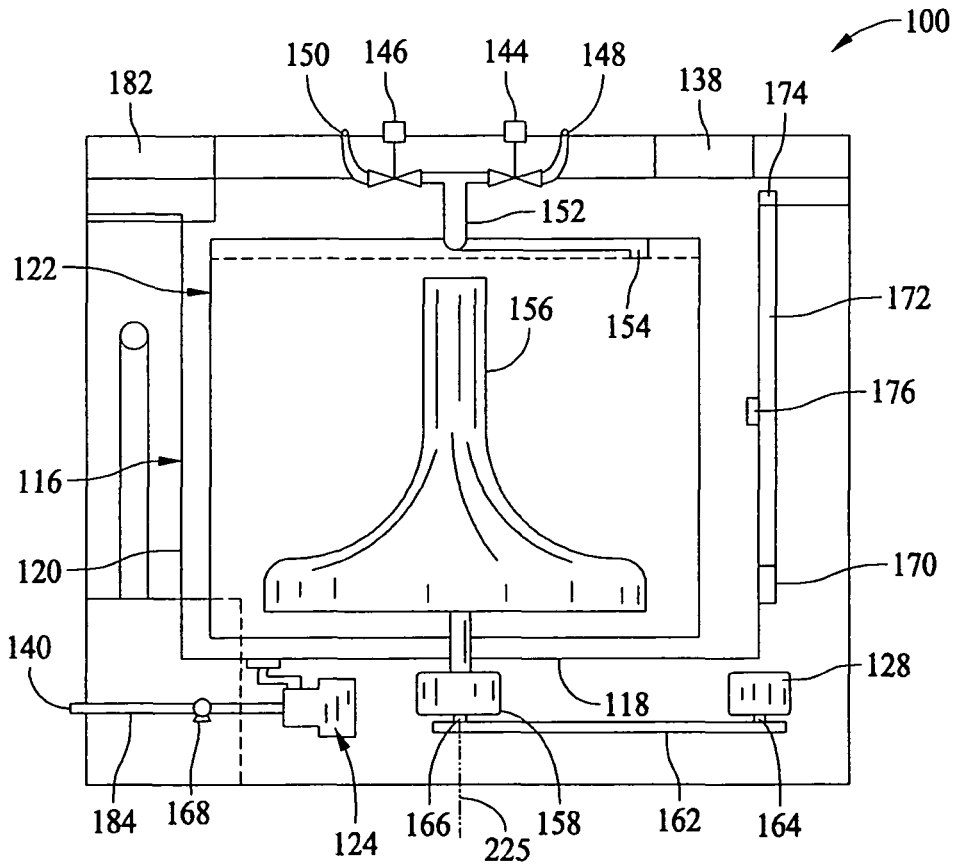
FIG. 2 is a sectional view of a portion of the washing machine shown in FIG. 1.

FIG. 2 is a sectional view of a portion of washing machine 100 including wash basket 122 movably disposed and rotatably mounted in wash tub 116 in a spaced apart relationship from tub bottom wall 118 and tub sidewall 120. Wash basket 122 includes a plurality of perforations therein for facilitating fluid communication between a cavity defined by wash basket 122 and a wash tub 116.

A hot water valve 144 and a cold water valve 146 deliver water to wash basket 122 and wash tub 116 through a respective hot water hose 148 and a cold water hose 150. Valves 144, 146 and hoses 148, 150 together form a water supply connection for washing machine 100 and, when connected to a building plumbing system (not shown), provide a fresh water supply for use in washing machine 100. Valves 144, 146 and hoses 148, 150 are connected to a wash basket inlet tube 152, and water is dispensed from inlet tube 152 through a nozzle assembly 154 having a plurality of openings therein to direct water into wash basket 122 at a given trajectory and/or velocity.

In one embodiment, an agitation element 156, such as a vane agitator, impeller, auger, oscillatory basket mechanism or a combination thereof, is disposed in wash basket 122 to impart an oscillatory motion to the articles at least partially suspended by the water within wash basket 122. Wash basket 122 and agitation element 156 are driven by motor 128 through a transmission and clutch system 158. A transmission belt 162 is coupled to respective pulleys of a motor output shaft 164 and a transmission input shaft 166. Thus, as motor output shaft 164 is rotated, transmission input shaft 166 is also rotated. The clutch system facilitates driving engagement of wash basket 122 and agitation element 156 for rotatable movement within wash tub 116. Further, in one embodiment, the clutch system facilitates relative rotation of wash basket 122 and agitation element 156 for selected portions of one or more wash cycles. Motor 128, transmission and clutch system 158, and belt 162 collectively are referred herein as a machine drive system.

Washing machine 100 also includes a brake assembly (not shown) selectively applied or released for respectively maintaining wash basket 122 in a stationary position within wash tub 116 or for allowing wash basket 122 to spin within wash tub 116. In one embodiment, pump assembly 124 is selectively activated to remove liquid including water containing used detergent and dirt removed from the washed articles from wash basket 122 and wash tub 116 through water outlet 140. in a particular embodiment, a drain valve 168 is coupled to water outlet 140 to control fluid flow through water outlet 140.

In one embodiment, washing machine 100 includes a reservoir 170, a tube 172 and a pressure sensor 174. As fluid levels rise in wash tub 116, air is trapped in reservoir 170 creating a pressure in tube 172 that pressure sensor 174 monitors. A second sensor 176 is positioned on an inside wall of wash tub 116 to detect a water temperature, a water hardness, a load size and/or a soil level for facilitating making associated control decisions. In an alternative embodiment, a plurality of sensors (not shown) is utilized to detect one or more of the water temperature, water hardness, load size and/or soil level during each wash cycle.

Figure 3:
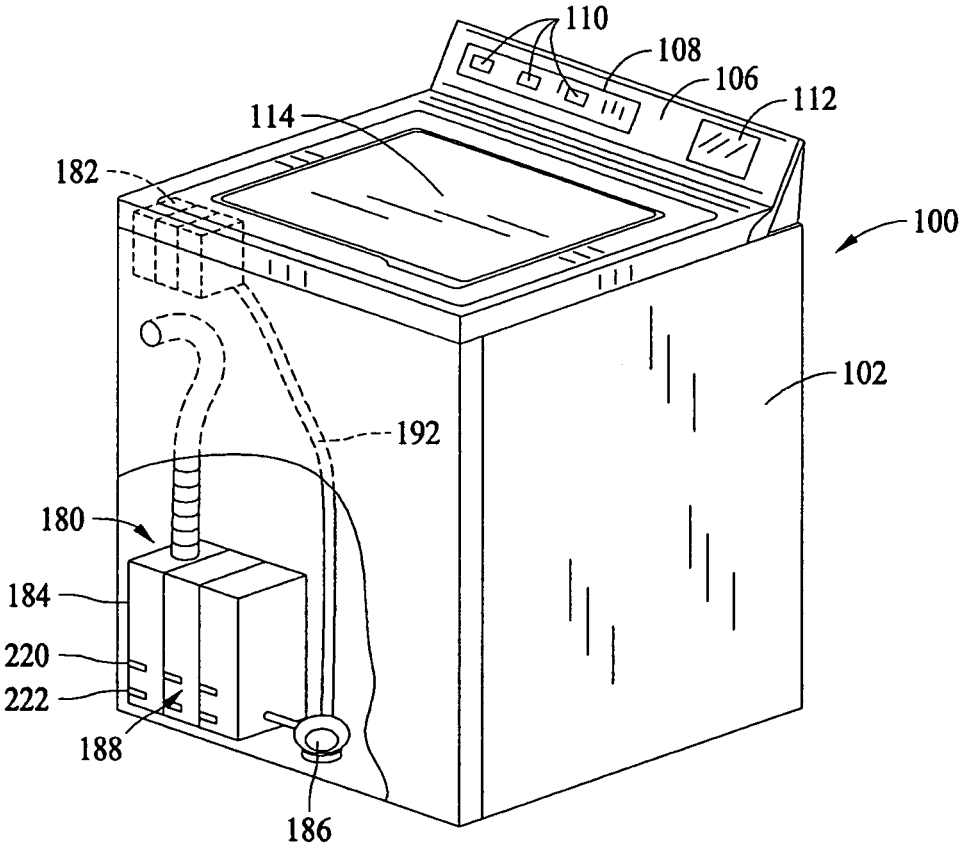
FIG. 3 is a perspective view of the washing machine shown in FIG. 1 with a portion of a cabinet removed.

FIG. 3 is a perspective view of washing machine 100 with a portion of cabinet 102 removed. As shown in FIG. 3, washing machine 100 includes a bulk dispensing system 180 for dispensing a fluid, such as detergent, bleach and/or softener, into washing machine 100, for facilitating cleaning articles loaded within washing machine 100. In one embodiment, bulk dispensing system 180 is mounted within cabinet 102.

As shown in FIG. 3, bulk dispensing system 180 includes a fluid compartment 182, a bulk storage container 184, a peristaltic pump 186, and a plurality of sensors 188. In one embodiment, fluid compartment 182 and bulk storage container 184 are mounted within cabinet 102 and in fluid communication with each other. Peristaltic pump 186 is in communication with fluid compartment 182 and bulk storage container 184. Peristaltic pump 186 is configured to transfer fluid from bulk storage container 184 to wash basket 122. Sensors 188 are positioned with respect to bulk storage container 184. Each sensor 188 is configured to detect a fluid level within bulk storage container 184. In one embodiment, sensor 188 is positioned within bulk storage container 184.

Figure 4:
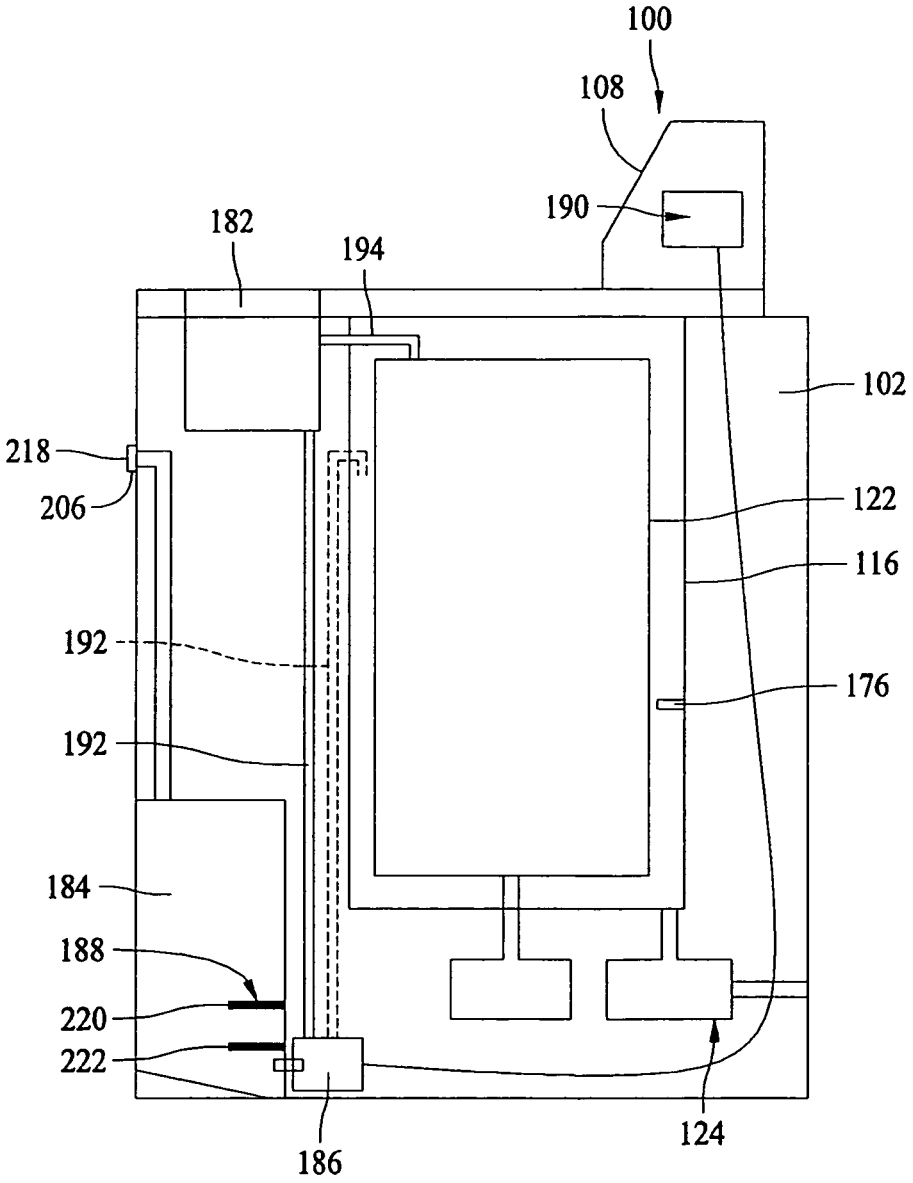
FIG. 4 is a partial sectional side view of the washing machine shown in FIG. 1.
Figure 5:
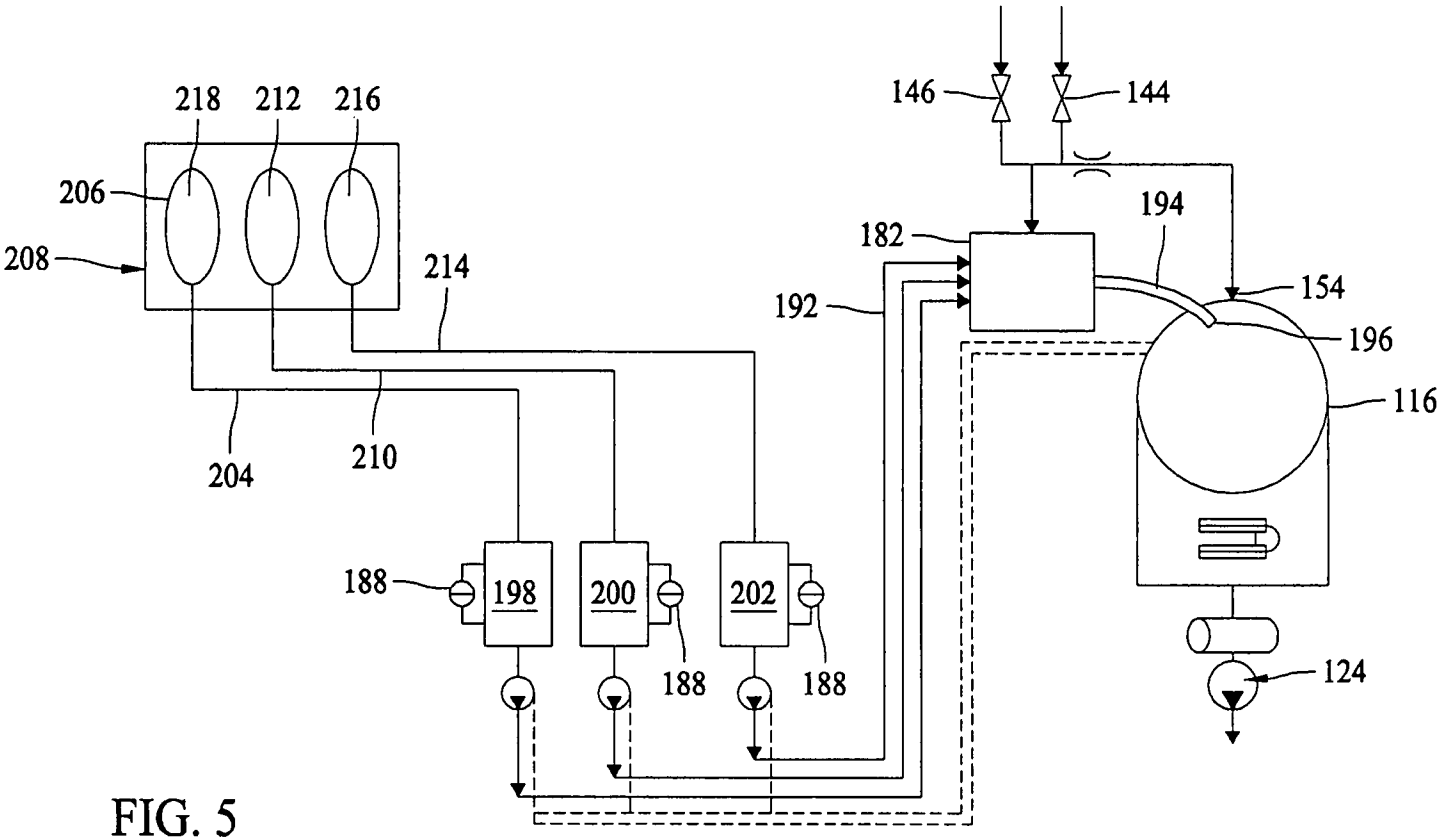
FIG. 5 is a schematic view of the washing machine shown in FIG. 1.

FIG. 4 is a partial sectional view of washing machine 100 shown in FIG. 1. FIG. 5 is a schematic view of washing machine 100, which indicates in greater detail couplings between components of washing machine 100. In one embodiment, bulk dispensing system 180 includes a controller 190 that is operatively coupled to peristaltic pump 186, sensors 188 and/or control panel 108 for user manipulation to select desired washing machine cycles and/or features. In response to user manipulation of input selectors 110 of control panel 108, controller 190 operates components of washing machine 100 to execute selected machine cycles and/or features. In one embodiment, controller 190 includes a microcomputer, a microprocessor and/or any suitable electronic component or circuit for facilitating processing signals received from components that are operatively coupled to controller 190.

In one embodiment, fluid compartment 182 is mounted on an inside wall of cabinet 102 at an upper portion thereof. Fluid compartment 182 is in fluid communication with bulk storage container 184 and wash tub 116 for selectively releasing a selected amount of fluid detergent and/or another suitable fluid, such as bleach and/or fabric softener, from bulk storage container 184 into wash tub 116. In one embodiment, a flexible fluid line or tube 192 extends from peristaltic pump 186 to fluid compartment 182 such that fluid within bulk storage container 184 can be transferred by peristaltic pump 186 to fluid compartment 182, which then releases the fluid into wash tub 116 at an appropriate time. In one embodiment, a tube 194 extends from fluid compartment 182 to wash basket 122. Tube 194 includes an exit nozzle 196, as shown schematically in FIG. 5, which is positioned in a path of incoming water flow into wash basket 122. As such, exit nozzle 196 will remain clean and fluid build up is prevented or limited for facilitating preventing blockage or clogs from forming within tube 194.

In an alternative embodiment, liquid line 192, as shown by phantom lines in FIG. 4, extends from peristaltic pump 186 to a space defined between wash tub 116 and wash basket 122. As such, fluid in bulk storage container 184 can be transferred to washing machine 100 without entering fluid compartment 182.

In one embodiment, bulk storage container 184 is positioned within cabinet 102 for containing fluid detergent and other suitable laundry additives for facilitating cleaning clothes and/or articles. Bulk storage container 184 is positioned at any suitable location with respect to washing machine 100, such as in the pedestal (not labeled) of washing machine 100 below cabinet 102. Bulk storage container 184 is sealed to prevent air from contacting the fluid and has suitable dimensions to accommodate or contain a desired amount of detergent and/or other laundry additives. In one embodiment, bulk storage container 184 has a sufficient volume or capacity to accommodate a suitable quantity of detergent and/or other laundry additives to allow use for up to about three months without the need to frequently add detergent and/or other laundry additives.

Referring to FIG. 5, in one embodiment bulk storage container 184 includes a first bulk storage tank 198, a second bulk storage tank 200 and a third bulk storage tank 202. In a particular embodiment, first bulk storage tank 198 is configured to contain fluid detergent, second bulk storage tank 200 is configured to contain bleach and third bulk storage tank 202 is configured to contain fabric softener. In this embodiment, bulk storage tanks 198, 200 and 202 are integrally formed. In an alternative embodiment, bulk storage tanks 198, 200 and/or 202 are separately located within cabinet 102 or washing machine 100. It is apparent to those skilled in the art and guided by the teachings herein provided that bulk storage container 184 may include any suitable number of bulk storage tanks, which may contain any suitable fluid material for facilitating washing articles within wash tub 116.

A first tube 204 extends from first bulk storage tank 198 to a first inlet opening 206 defined by a front panel 208 of washing machine 100 to provide fluid communication therebetween. Similarly, a second tube 210 extends from second bulk storage tank 200 to a second inlet opening 212 and a third tube 214 extends from third bulk storage tank 202 to third inlet opening 216. In an alternative embodiment, inlet openings 206, 212, 216 are defined in cover 104 of washing machine 100. In a particular embodiment, a lid 218 covers each inlet opening 206, 212, 216. Lid 218 is movably coupled to cabinet 102 to cover inlet openings 206, 212 and/or 216. When fluid is required in a respective bulk storage tank 198, 200, 202, lid 218 is movable to provide communication between inlet opening 206, 212, 216 and respective bulk storage tank 198, 200, 202.

In one embodiment, sensors 188 facilitate detecting fluid levels within bulk storage tanks 198, 200 and/or 202. In a particular embodiment, a first fluid level sensor 220 and a second fluid level sensor 222 are positioned at a first position and a second position, respectively, on an inside wall of first bulk storage tank 198 for detecting selected levels of fluid within first storage tank 198. More particularly, first fluid level sensor 220 is positioned at a first position. In one embodiment, first fluid level sensor 220 is in electrical communication with controller 190 and is configured to alert a user when fluid in first storage tank 198 is below a predetermined level. Second fluid level sensor 222 is positioned at a second lower position and is configured to detect when first storage tank 198 is empty. In one embodiment, second fluid level sensor 222 is in electrical communication with controller 190 and configured to detect when first storage tank 198 is empty. If second fluid level sensor 222 senses that first storage tank is empty, second fluid level sensor 222 transmits a signal to controller 190. In response to the transmitted signal, controller 190 prevents activation of peristaltic pump 186 with first storage tank 198 empty. Similarly, additional first fluid sensors 220 and/or second fluid level sensors 222 are respectively positioned within second bulk storage tank 200 and/or third bulk storage tank 202 and are similarly arranged as first fluid level sensor 220 and second fluid level sensor 222 within first bulk storage tank 198.

In one embodiment, clothes and/or other soiled articles are loaded into wash basket 122. A washing operation is initiated through operator manipulation of control input selectors 110 shown in FIG. 1. In one embodiment, wash tub 116 is filled with a selected amount of water. During the introduction of water into wash tub 116, controller 190 determines a selected amount of fluid detergent based on a load size detected by second sensor 176 and actuates peristaltic pump 186 to transfer or move fluid detergent from bulk storage container 184 to wash tub 116 or to fluid compartment 182 which then releases the fluid detergent to wash tub 116.

Wash basket 122 is agitated with agitation element 156 for facilitating cleaning the clothes and/or articles within wash basket 122. Agitation element 156 moves in an oscillating motion. In this embodiment, agitation element 156 is rotated clockwise a distance about vertical axis 225 of washing machine 100, and then rotated counterclockwise a distance about vertical axis 225. The clockwise/counterclockwise motion is sometimes referred to as a stroke, and the agitation phase of the wash cycle constitutes a number of strokes in sequence. Acceleration and deceleration of agitation element 156 during the strokes imparts mechanical energy to the clothes and/or articles within wash basket 122 for facilitating cleaning the clothes and/or articles. In alternative embodiments, washing machine 100 includes a reversible clutch and/or any suitable agitation element 156.

After the agitation phase of the wash cycle is completed, tub 116 is drained with pump assembly 124. Clothes are then rinsed and portions of the cycle repeated. In one embodiment, detergent and/or other suitable laundry additives are selectively introduced into wash basket 122, depending on the wash cycle selected by a user. During the wash cycle, controller 190 determines an appropriate amount of fluid at an optimum time and commands dispensing system 180 to dispense the determined fluid into wash tub 116 based on a detected water temperature, water hardness, load size and/or soil level. More specifically, when second sensor 176 detects a water parameter, such as a water temperature, water hardness, soil level and/or another parameter, such as load size, controller 190 receives a signal from second sensor 176 and determines an appropriate amount of fluid to be dispensed using a suitable algorithm. Controller 190 activates peristaltic pump 186 to transfer or move fluid from bulk storage container 184 to wash tub 116 or to fluid compartment 182 which then releases fluid to wash tub 116. In one embodiment, second sensor 176 detects excessive foam in wash tub 116, second sensor 176 transmits a signal to controller 190, which then activates peristaltic pump 186 to dispense fabric softener from third storage tank 202 into wash tub 116. In one embodiment, bleach can be selectively transferred or moved from second bulk storage tank 200 to wash tub 116 through peristaltic pump 186 as required by selected wash cycle.

While the invention has been described in terms of various specific embodiments, those skilled in the art will recognize that the invention can be practiced with modification within the spirit and scope of the claims.

What is claimed is:

1. A bulk dispensing system for a washing machine, the washing machine comprising a cabinet, a tub mounted within the cabinet, and a conduit for providing a stream of water into the tub, said bulk dispensing system comprising:

a fluid compartment mounted within the washing machine, said fluid compartment configured to selectively release fluid into the tub;

at least one bulk storage tank mounted within the washing machine;

a first flow tube providing fluid communication between said at least one bulk storage tank and said fluid compartment;

a second flow tube providing fluid communication between said fluid compartment and the tub mounted within the cabinet of the washing machine;

an outlet nozzle coupled to an end of the second flow tube, the outlet nozzle extending away from the fluid compartment and positioned in a path of the stream of water introduced from the conduit into the tub, wherein the outlet nozzle is disposed outside of the conduit providing the stream of water into the tub;

a pump operatively coupled to said first flow tube and configured to move fluid from within said at least one bulk storage tank to said fluid compartment through said first flow tube;

an inlet tube providing fluid communication between said at least one bulk storage tank and an inlet opening, said inlet opening and said inlet tube configured to supply fluid to said at least one bulk storage tank;

a reservoir tube mounted within the washing machine;

a pressure sensor operatively coupled to said reservoir tube, said pressure sensor configured to measure a pressure within said reservoir tube; and a controller operatively coupled to said pump and configured to control an amount of fluid moved into the tub.

2. A bulk dispensing system in accordance with claim 1 further comprising a first sensor positioned within said at least one bulk storage tank, said first sensor in electrical communication with said controller and configured to alert a user when fluid in said at least one bulk storage tank is below a predetermined level.

3. A bulk dispensing system in accordance with claim 1 wherein said pump comprises a peristaltic pump mounted to a bottom panel of the washing machine.

4. A bulk dispensing system in accordance with claim 1, wherein said at least one bulk storage tank comprises a first bulk storage tank configured to hold detergent, a second bulk storage tank configured to hold bleach, and a third bulk storage tank configured to hold fabric softener.

5. A bulk dispensing system in accordance with claim 1 wherein said controller is configured to automatically move a selected amount of fluid from the at least one bulk storage tank into said fluid compartment, and from said fluid compartment into the tub.

6. A bulk dispensing system in accordance with claim 5 wherein said controller determines the selected amount of fluid based on at least one of a water temperature, a water hardness, a load size and a soil level.

7. A bulk dispensing system in accordance with claim 1 further comprising a sensor positioned within said at least one bulk storage tank, said sensor in electrical communication with said controller and configured to detect when said at least one bulk storage tank is empty, said sensor transmitting a signal to said controller when said at least one bulk storage tank is empty, and said controller preventing activation of said pump when said at least one bulk storage tank is empty.

8. A bulk dispensing system in accordance with claim 1 wherein said pump is configured to maintain fluid within said first flow tube.

9. A bulk dispensing system in accordance with claim 1, wherein the conduit for providing the stream of water into the tub introduces water into the tub separately from the fluid released by the fluid compartment into the tub.

10. A washing machine comprising:

a cabinet;

a tub mounted within said cabinet;

a conduit for providing a stream of water into the tub;

a fluid compartment positioned within said cabinet, said fluid compartment configured to selectively release fluid into said tub;

a first bulk storage tank positioned within said cabinet;

a first flow tube providing fluid communication between said first bulk storage tank and said fluid compartment;

a second flow tube providing fluid communication between said fluid compartment and said tub;

an outlet nozzle coupled to an end of said second flow tube away from the fluid compartment, said outlet nozzle being disposed outside of the conduit and positioned in a path of the stream of water introduced from the conduit into said tub;

a peristaltic pump operatively coupled to said first flow tube, said peristaltic pump configured to move fluid from within said first bulk storage tank into said fluid compartment through said first flow tube;

an inlet tube providing fluid communication between said first bulk storage tank and an inlet opening, said inlet opening and said inlet tube configured to supply fluid to said first bulk storage tank;

a reservoir tube mounted within said washing machine;

a pressure sensor operatively coupled to said reservoir tube, said pressure sensor configured to measure a pressure within said reservoir tube; and a controller in control communication with said peristaltic pump and configured to control an amount of fluid introduced into said tub.

11. A washing machine in accordance with claim 10 further comprising a second bulk storage tank and a third bulk storage tank positioned within said cabinet, said first bulk storage tank configured to contain detergent, said second bulk storage tank configured to contain bleach, and said third bulk storage tank configured to contain fabric softener.

12. A washing machine in accordance with claim 11 wherein each of said first bulk storage tank, said second bulk storage tank and said third bulk storage tank is sealed to prevent air from contacting the fluid.

13. A washing machine in accordance with claim 10 further comprising a first sensor positioned with respect to said first bulk storage tank and configured to detect a fluid level within said first bulk storage tank, said first sensor in electrical communication with said controller and configured to transmit a signal to said controller when the fluid level within said first bulk storage tank is below a determined level.

14. A washing machine in accordance with claim 13 further comprising a second sensor mounted with respect to said tub, said second sensor in electrical communication with said controller and configured to detect at least one of a water temperature, a water hardness, a load size and a soil level within said tub.

15. A washing machine in accordance with claim 10 further comprising a sensor positioned with respect to said first bulk storage tank, said sensor in electrical communication with said controller and configured to detect when said at least one bulk storage tank is empty, said sensor configured to transmit a signal to said controller when said first bulk storage tank is empty, and said controller configured to prevent activation of said peristaltic pump when said first storage tank is empty.

16. A washing machine in accordance with claim 10 wherein said controller is configured to automatically move a selected amount of fluid from said first bulk storage tank into said fluid compartment, and from said fluid compartment into said tub based on at least one of a water temperature, a water hardness, a load size and a soil level within said tub.

* * * * *